US005370856A

United States Patent [19]

Arai et al.

[11] Patent Number: 5,370,856

[45] Date of Patent: Dec. 6, 1994

[54] HIGH STRENGTH CARBON FIBER AND PRE-CARBONIZED FIBER

[75] Inventors: Yutaka Arai, Tokyo; Masatoshi Furuyama, Kawasaki; Hirofumi Sunago; Tadao Tomioka, both of Tokyo, all of Japan

[73] Assignees: Nippon Steel Corporation; Nippon Steel Chemical Co., Ltd., both of Tokyo, Japan

[21] Appl. No.: 976,701

[22] Filed: Nov. 16, 1992

Related U.S. Application Data

[63] Continuation of Ser. No. 679,907, Apr. 3, 1991, abandoned.

[30] Foreign Application Priority Data

Apr. 6, 1990 [JP] Japan ..... 2-90178

[51] Int. Cl.[5] ..... D01F 9/12

[52] U.S. Cl. ..... 423/447.2

[58] Field of Search ..... 423/447.2; 264/29.2; 208/22

[56] References Cited

U.S. PATENT DOCUMENTS

| | | | |
|---|---|---|---|
| 4,005,183 | 1/1977 | Singer | 423/447.2 |
| 4,017,378 | 4/1977 | Fauveau et al. | 423/448 |
| 4,818,612 | 4/1989 | Hara et al. | 423/447.2 |
| 4,865,931 | 9/1989 | McCullough, Jr. et al. | 423/447.2 |
| 4,945,014 | 7/1990 | Miyabayashi et al. | 423/448 |
| 5,030,435 | 7/1991 | Kitamura et al. | 423/447.2 |
| 5,114,697 | 5/1992 | Naito et al. | 923/447.2 |

FOREIGN PATENT DOCUMENTS

| | | | |
|---|---|---|---|
| 58-120818 | 7/1983 | Japan | 264/29.2 |
| 60-259629 | 12/1985 | Japan | D01F 9/14 |
| 61-215716 | 9/1986 | Japan | D01F 9/12 |
| 61-225330 | 10/1986 | Japan | D01F 9/12 |
| 62-41320 | 2/1987 | Japan | D01F 9/14 |
| 62-104927 | 5/1987 | Japan | D01F 9/14 |
| 63-120112 | 5/1988 | Japan | D01F 9/14 |
| 1-314733 | 12/1989 | Japan | D01F 9/14 |

*Primary Examiner*—Michael Lewis
*Assistant Examiner*—Stuart L. Hendrickson
*Attorney, Agent, or Firm*—Kenyon & Kenyon

[57] ABSTRACT

A graphitized fiber heat-treated at a temperature higher than 2300° C. in an inert atmosphere, of which oxidation weight reduction rate A in dry air at 650° C. is in the range defined by the equation (1), of which BET specific surface area S determine by nitrogen or krypton adsorption technique at −196° C. is in the range defined by the equation (2), and of which pore volume determined by the carbon dioxide adsorption technique at 25° C. is 0.001 ml/g or less:

$$\frac{0.15}{D} \leqq A \leqq \frac{0.6}{D} \quad (1)$$

$$\frac{1}{0.25D\rho} \leqq S \leqq \frac{1}{0.08D\rho} \quad (2)$$

where, A is the oxidation weight reduction rate in dry air at 650° C. in $min^{-1}$ S is the specific surface area determine by nitrogen or kypton adsoprtion technique at −196° C. in $m^2g^{-1}$ D is the mean monofilament diameter of the graphitized fiber in $\mu m$ and $\rho$ is the density of the graphitized fiber in $gcm^{-3}$.

2 Claims, 1 Drawing Sheet

HIGH STRENGTH CARBON FIBER AND PRE-CARBONIZED FIBER

This application is a continuation, of application Ser. No. 07/679,907 filed Apr. 3, 1991 now abandoned.

BACKGROUND OF THE INVENTION

1. Field of the Invention

The present invention relates to a carbon fiber having a novel structure providing a high strength and high modulus obtained by using a mesophase pitch as the starting material, and a precursor thereof. More specifically, it pertains to a high performance pitch based carbon fiber having a high strength and high modulus, particularly a improved tensile strength, and having a modified fiber surface structure, and a precursor thereof, i.e., a pre-carbonized fiber.

2. Description of the Related Art

Carbon fibers have a high specific strength and specific modulus and have attracted attention as strong and light materials for use in the fields of space craft, automobiles, and other industries. In such fields, there is a need for inexpensive materials having a high strength and high modulus.

Known carbon fibers include PAN based carbon fibers obtained by using polyacrylonitrile (PAN) as the starting material and pitch based carbon fibers obtained by using pitch as the starting material, but currently, the PAN based carbon fibers are primarily used as high performance carbon fibers having a high strength and high modulus.

PAN based carbon fibers, however, should be subjected to heat-treatment processes to achieve a very high modulus, The PAN used as the starting material therefor is expensive, and the carbon yield of PAN is low, thus the PAN based carbon fiber is inevitably high.

Accordingly, there has been proposed a carbon fiber having a three-dimensional polycrystalline graphite structure order, which is disclosed in U.S. Pat. No. 4,005,183. The carbon fiber is obtained by using a mesophase pitch as the starting material at a very high carbon fiber yield and a easily has a very high modulus.

Recently, improved pitch based carbon fiber and their structures having an even higher strength have been proposed. For example, there have been proposed a structure in which the graphite crystals in the fiber cross-sectional direction are made finer by stirring the portion immediately above the capillary portion of spinning nozzles, as disclosed in Japanese Unexamined Patent Publication (Kokai) No. 62-104927; the structure in which the carbon layer surface in the fiber cross-sectional direction is folded, as disclosed in Japanese Unexamined Patent Publication (Kokai) No. 62-41320; or the structure in which a lattice pattern is formed on the fiber cross-section by placing a metal net in front of the nozzle, as disclosed in U.S. Pat. No. 4,818,612. These structures are all produced by modifying the process, and the graphite crystals constituting the fiber are made finer, and the fiber becomes to be less graphitizeable in the cross-sectional direction.

As the method of obtaining a novel fiber structure by modifying a infusibilization or carbonization process, or by a combination of both, a fiber structure is known in which the graphite crystallizability internally of the fiber is improved by a selective infusibilization of the outer surface layer portion of the fiber, as disclosed in Japanese Unexamined Patent Publication (Kokai) No. 63-120112. This fiber structure has a specific feature in that a high modulus can be easily obtained.

As the preparation method, Japanese Unexamined Patent Publication (Kokai) No. 1-314733 discloses a method of obtaining a high strength by incorporating iodine with an atmospheric gas during the infusibilization process. This publication states that this method can be used to prepare a fiber with substantially no defects, by suppressing the oxygen introduced into the fiber during the infusibilization to a minimum value.

Japanese Unexamined Patent Publication (Kokai) No. 60-259629 discloses a method of preparing graphitized fibers having the advantages of a shortened infusibilization and carbonization time, and a high strength, by graphitizing the fusibilized fiber infusibilized with nitrogen dioxide at a temperature elevation speed of 40° C./min or higher. In a fiber disclosed in Japanese Unexamined Patent Publication (Kokai) No. 60-259629, a satisfactory physical property can not be obtained by passing same through the pre-carbonized fiber stage, as described hereinbelow. The high strength carbon fiber of the present invention naturally derived from the fiber structure obtained at the pre-carbonized fiber stage is different from that of the fiber disclosed in! Japanese Unexamined Patent Publication No, 60-259629.

Japanese Unexamined Patent Publication (Kokai) No. 61-215716 discloses a method of improving the tensile strength by a gas phase oxidation of the pitch based carbon fiber surface under specific conditions. This method is considered to improve the carbon fiber's physical properties by etching the carbon fiber surface to remove defects thereon.

Japanese Unexamined Patent Publication (Kokai) No. 61-225330 discloses a high strength PAN based carbon fiber having a structure in which the surface layer portion has substantially the same perfection as a crystal composing the fiber center portion, and a less perfection of an ultra-thin outermost layer portion. This fiber structure is obtained by subjecting the PAN type carbon fibers to an electrochemical oxidation treatment under specific conditions, and then inactivating same in an inert or reducing atmosphere.

As a result of the investigations by the present inventors it was found that, even when this method is applied to the mesophase pitch based carbon fibers to obtain a similar fiber structure, the tensile strength not improved, but instead, was lowered. This was considered to be due to the great difference in the fiber structure of the PAN based carbon fibers and that of the pitch based carbon fibers, as can be seen from the crystallite sizes.

Therefore, for the pitch based carbon fibers having a high strength as proposed in the prior art, there have been only proposed a structure in which the crystals in the fiber cross-sectional direction were made finer, or a conventional strength improvement method of reducing various defects occurring during preparation of fibers, as much as possible, and a novel carbon fiber structure having a high strength and high modulus and retaining the inherent characteristics of the pitch type carbon fiber has not been proposed.

Potential defects occurring in the steps of preparing the carbon fibers, or surface defects occurring during the handling after the preparation of the carbon fibers will greatly lower the strength of carbon fibers.

SUMMARY OF THE INVENTION

Accordingly, the objects of the present invention are to eliminate the above-mentioned disadvantages of the prior art and to provide a pitch type carbon fiber having a novel carbon fiber structure providing a high strength and high elasticity, by preventing a lowering in the strength due to various defects, by using a novel carbon fiber structure, and a precursor thereof.

Other objects and advantages of the present invention will be apparent from the following description.

In accordance with the present invention, there is provided a graphigized fiber heat-treated at a temperature higher than 2300° C. in an inert atmosphere, of which oxidation weight reduction rate A in dry air at 650° C. is in the range defined by the equation (1), of which BET specific surfaces area S determine by nitrogen or krypton adsorption technique at −196° C. is in the range defined by the equation (2), and of which pore volume determined by the carbon dioxide adsorption technique at 25° C. is 0.001 ml/g or less;

$$\frac{0.15}{D} \leqq A \leqq \frac{0.6}{D} \quad (1)$$

$$\frac{1}{0.25D\rho} \leqq S \leqq \frac{1}{0.08D\rho} \quad (2)$$

where, A is the oxidation weight reduction rate in dry air at 650° C. in $min^{-1}$ S is the specific surface area determine by nitrogen or krypton adsorption technique at −196° C. in $m^2g^{-1}$ D is the mean monofilament diameter of the graphitezed fiber in μm and ρ is the density of the graphitized fiber in $g \cdot cm^{-3}$.

Alternatively, the above object can be accomplished by providing carbon fibers and graphitized fibers obtained by carbonizing and graphitizing a pre-carbonized fiber obtained by a heat treatment at a temperature from 800° C. to 900° C. of a mesophase pitch derived pitch precursor fiber, of which BET specific surface area S determined by the nitrogen adsorption technique at −196° C. is in the range defined by the equation (3), of which pore volume determined by the carbon dioxide adsorption technique at 25° C. is 0.1 $mlg^{-1}$ or less:

$$\frac{1}{0.045D\rho} \leqq S \leqq \frac{1}{0.005D\rho} \quad (2)$$

where, S is the specific surface area determined by nitrogen adsortion techique −196° C. in $m^2g^{-1}$.

D is the mean monofilament diameter of the pre-carbonized fiber in μm and

ρ is the density of the pre-carbonized fiber in $g \cdot cm^{-3}$.

Namely, the present inventors, on the basis of the concept that the graphite crystals constituting the carbon fibers are homogeneous over the whole fiber, i.e., form a dense fiber structure, and further, the stress concentration at the surface defective portions is relaxed by introducing a certain kind of disturbance at the carbon fiber surface portion, made an intensive study of the structure of the carbon fiber and the precursor having a high tensile strength, and thus accomplished the present invention.

In the present invention, the heat treatment in an inert atmosphere is called carbonization. Particularly, a treatment at a temperature lower than 800° C. is called a low temperature carbonization, and the fiber obtained is called a low temperature carbonized fiber; a treatment at a temperature of 800° to 900° C. is called pre-carbonization, and the fiber obtained is called a pre-carbonized fiber; the fiber treated at 1300° C. or higher is called a carbon fiber, a treatment of which particularly at a temperature at 2000° C. or higher, is called graphitization, and the fiber obtained is called a graphitized fiber. The term precursor fiber includes the infusibilized fiber, low temperature carbonized fiber, and pre-carbonized fiber.

BRIEF DESCRIPTION OF THE DRAWINGS

The present invention will be better understood from the description set forth below with reference to the accompanying drawing of FIG. 1, which is a drawing showing the pore distribution curve obtained according to the method of Dollimore-Heal from the nitrogen adsorption isothermal curve of the pre-carbonized fibers heat treated at 875° C. which are mentioned Example 1 and Comparative Example 1.

DESCRIPTION OF THE PREFERRED EMBODIMENTS

Figure 1:
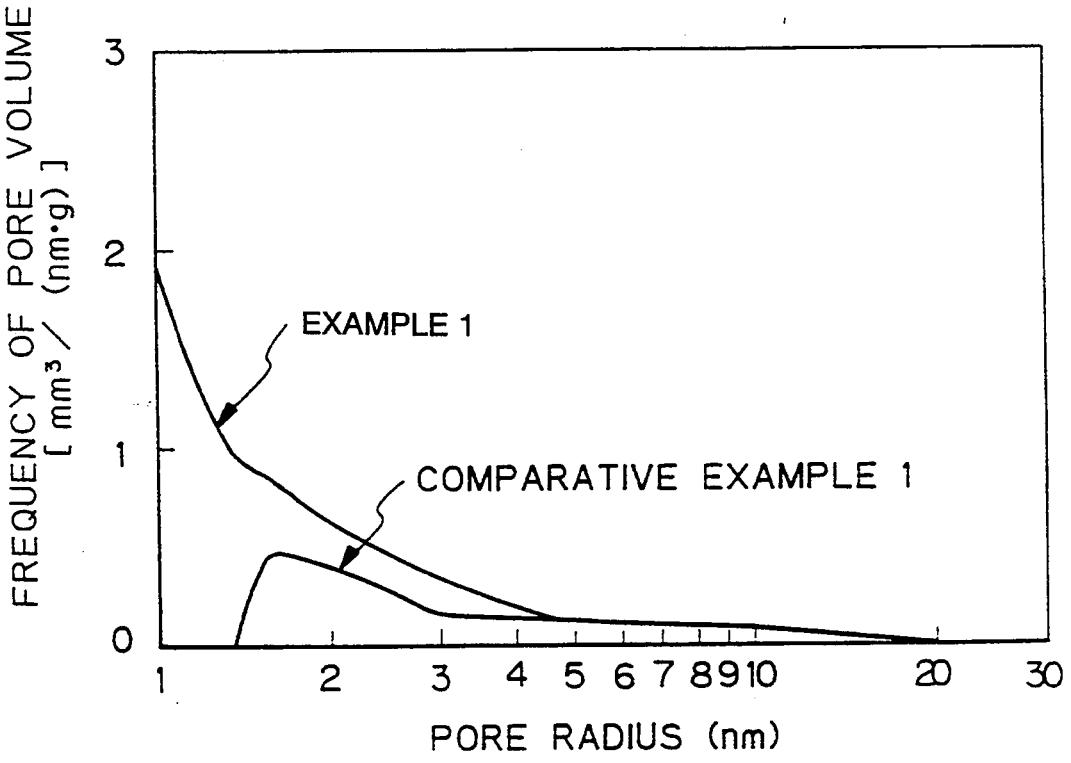

Examples of the pitch used as the starting material for the carbon fibers in the present invention include various pitches, i.e., coal based pitches such as coal tar and coal tar pitch, petroleum based pitches such as carbon liquefied pitch, ethylene tar pitch, and decant oil pitch obtained from fluidized catalytically cracked oil, or synthetic pitches prepared from naphthalene by use of a catalyst.

The mesophase of the mesophase pitch to be used for the carbon fibers of the present invention is prepared from the above-mentioned pitch by methods in the prior arts. The mesophase pitch preferably gives a pitch fiber with very high orientation of molecules along the fiber axis by spinning, and accordingly, the mesophase content is preferably 40% or more, more preferably 70% or more. The mesophase pitch to be used in the present invention preferably has a softening point of 200° to 400° C., more preferably 250° to 350° C.

Pitch fibers can be obtained by melt spinning the above-mentioned mesophase pitch by a method known in the prior arts. For example, the above-mentioned mesophase pitch is drawn at a take-up speed of 100 to 2000 m/min while extruding same at a temperature at which a viscosity of 100 poise to 2000 poise is obtained through a capillary with an orifice diameter of 0.1 mm to 0.5 mm under a pressure of about 0.1 to 100 $kg/cm^2$, to obtain pitch fibers with a fiber diameter of 5 to 20 μm.

Next, the pitch fibers are converted to the thermoset fibers by the infusibilization treatment according to methods already known. For example, in an atmosphere of air, an oxidative gas in which the oxygen concentration is controlled by an addition of an inert gas or oxygen to air, or these gases mixed with ozone, nitrogen dioxide gas, nitrogen monooxide gas, or sulfur dioxide gas, the infusibilization treatment for oxidizing pitch fibers is carried out by raising the temperature from a temperature lower than the softening point of the pitch.

The precursor fibers of the present invention can be obtained by treating the infusibilized fibers thus obtained, or the low temperature carbonized fibers or pre-carbonized fibers obtained previously by carbonizing the infusibilized fibers in an inert gas atmosphere of nitrogen at 300° to 900° C., more preferably 400° to 900° C., in a carbon dioxide gas-containing atmosphere at 5% or more by volume of carbon dioxide gas, more preferably 20% or more by volume, and at a temperature of 500° to 1000° C., preferably 500° to 900° C.

Alternatively, the precursor fibers of the present invention can be obtained by a treatment under specific infusibilization conditions, followed by a low temperature carbonization if necessary. Specifically, the precursor fibers can be obtained by infusibilization in a gas mixture atmosphere having a nitrogen dioxide concentration of 5 to 10% by volume, an oxygen concentration of 2 to 20% by volume, the balance being an inert gas such as nitrogen, at a temperature of 150° to 320° C. for a treatment time of 60 to 300 min, preferably 90 to 240 min, followed by a low temperature carbonization of the infusibilized fiber if necessary. Particularly, in the precursor fibers of the present invention, different from the infusibilization method of the prior art using nitrogen dioxide, the infusibilization should be carried out for a long time. This specific heat treatment in a carbon dioxide atmosphere described in the above paragraph of the precursor fibers, allows the forming of precursor fibers having more preferable characteristics.

The precursor fibers of the present invention must have a BET specific surface area S determined by nitrogen adsorption at −196° C. of the pre-carbonized fiber pre-carbonized in an inert atmosphere at a temperature of 800° to 900° C., and a fine volume, determined by the carbon dioxide adsorption at 25° C., of 0.1 ml/g or less:

$$\frac{1}{0.045D\rho} \leqq S \leqq \frac{1}{0.005D\rho}$$

where,

S: specific surface area ($m^2/g$),

D: monofilament fiber diameter of pre-carbonized fiber (μm)

ρ: density of pre-carbonized fiber ($g/cm^3$).

Here, the specific surface area determined by nitrogen absorption or krypton adsorption techniques is a value estimated, on the basis of the BET multi-point method, from the adsorption isothermal curve measured by the constant pressure volume method at a temperature of −196° C. of the pre-carbonized fiber dried under a reduced pressure of $10^{-4}$ torr at 250° C. The fine volume is a value determined on the basis of the Dubinin-Polanyi theory ("Chemistry and Physics of Carbon", vol. 2, Marcel Dekker, Inc., New York, 1966, p. 51) from the adsorption isothermal curve measured by the constant pressure volume method at a temperature of 25° C. of the carbonized fiber dried under a reduced pressure of $10^{-4}$ torr at 250° C. The value of the specific surface area and the value of the pore volume shown here are determined by the micropores formed in the precursor fibers.

The specific surface area obtained by the nitrogen or krypton adsorption method represents an amount of relatively large fine pores, and if this value of the pre-carbonized fiber is less than $1/(0.045\times D\times\rho)$, the pores become to closed or no pores exists after heat treatment at higher temperature, where by it is impossible to introduce a desired disturbance on the surface of the resultant carbonfiber. On the other hand, if the area S of the pre-carbonized fiber exceeds $1/(0.005\times D\times\rho)$, the disturbance remaining on the surface of the resultant fiber becomes too large, and will cause a lowering of the strength of the carbon fiber. Further, if the value of total pore volume obtained by carbon dioxide adsorption technique of the pre-carbonized fiber exceeds 0.1 ml/g, it is difficult to form a dense structure, and therefore, high performance carbon fibers are difficult to be obtain.

Also, the pore distribution of a pre-carbonized fiber is important as the constituent element of the present invention. Preferably, the pore radius at the peak positions of the pore distribution determined by the method of Dollimore-Heal (J. Applied., Chemi., vol. 14, p. 109, 1966) from the nitrogen adsorption isothermal curves measured by the constant pressure volume method at a temperature of −196° C. is 1.3 nm or less, and the total pore volume determined by this method is 0,002 ml/g or more.

FIG. 1 shows the volume distribution curves of the precursor fiber (Example 1) and the fiber of the prior art (Comparative example 1) determined from the nitrogen adsorption isothermal curves of the pre-carbonized fibers at a carbonization temperature of 875° C. The presence of pores with radius of 1.3 nm or less of the pre-carbonized fiber provides a novel structure to the resultant carbon fiber which was heat treated at a higher temperature than 1300° C., by introducing a kinds of disturbance to the surface. Also a total amount of the pores of 0,002 ml/g or more in this method will provide a fiber structure leading to the greater strength.

The porosity of the fiber structure when graphitized at a temperature of 2300° C. or higher in an inert atmosphere can be evaluated by the BET specific surface area determined by nitrogen or krypton adsorption technique at −196° C., and the pore volume determined by the carbon dioxide adsorption technique at 25° C. A dense fiber structure with excellent physical properties is achieved by controlling the BET specific surface area S determined by nitrogen adsorption technique at −196° C. to be within the range of the formula shown below, and by depressing pore volume determined from carbon dioxide adsorption technique at 25° C. to be 0.001 ml/g or less.

$$\frac{1}{0.25\times D\times\rho} \leqq S \leqq \frac{1}{0.08\times D\times\rho}$$

where,

S is the specific surface area determined by nitrogen or krypton adsorption technique at −196° C. in $m^2\cdot g^{-1}$ D is the mean monofilament diameter of the graphitized fiber in μm and ρ is the density of the graphitized fiber in $g\cdot cm^{-3}$.

If the specific surface area value of the graphitized fiber graphitized at a temperature of 2300° C. or higher exceeds $1/(0.08\times D\times\rho)$, or the total pore volume exceeds 0.001 ml/g, it is difficult to obtain a dense structure which is indispensable to a high strength and a high modulus.

A certain kind of disturbance on the surface of the carbon fiber having a densely developed fiber structure can be estimated from the oxidation weight reduction rate in dry air at 650° C. This oxidation technique is very sensitive to the surface disturbance, and clearly distinguish the small difference on the surface disturbance of the fibers is almost free the surface disturbance.

The weight reduction rate is measured by using a thermobalance at 650° C. A sample to be measured is charged into the thermobalance, the temperature of which is then elevated from room temperature to 650° C. in a nitrogen gas stream, and after stabilization of the temperature, the sample weight is read and this value is defined as w1. Then, the atmosphere is changed to dry air, an oxidation weight reduction effected in a dry air stream for 30 min., and the sample weight w2 at this time read. The oxidation weight reduction rate A is calculated from the following formula:

$$A = \frac{w1 - w2}{30 \times w1}$$

If the reduction rate at this time is less than 0.15/D, no improvement of strength can be seen, and the introduction of a certain kind of disturbance may be considered to be insufficient. On the other hand, if it exceeds 0.6/D, the fiber strength decreases because of destruction of the dense structure.

Graphitized fibers properly infusibilized, heat treated, and with not so much disturbance on the surface exhibit very homogeneous and dense structures as observed by transmitted electron microscopy (TEM).

A graphitized fiber with a dense structure, and heat treated at a temperature higher than 2300° C. possesses the interlayer spacing $d_{002}$ of 0.3435 nm or less and crystallite size Lc or 8.0 nm or more which are determined by X-ray diffraction technique.

Accordingly, these graphitized fibers have excellent characteristics with a tensile modulus of 40 tf/mm$^2$ or higher, preferably 50 tf/mm$^2$ or higher, with the graphite crystals highly oriented along the fiber axis, and a tensile strength of 300 kgf/mm$^2$ or higher.

The reason why the novel carbon fiber structure according to the present invention produces carbon fibers or graphitized fibers having an excellent tensile strength and tensile modulus has not been fully clarified, but the present inventors consider that the following assumptions can be made.

Ideally, carbon fibers or graphitized fiber having excellent physical properties should reflect the complete orderly dense structure possessed by the graphite crystals, but in practice various defects are introduced during the fiber preparation, whereby the physical properties are damaged. Particularly, the presence of defects greatly influences the tensile strength. An ideally dense crystalline structure has a high strength when no defects exist, but once a defect is introduced, the stress concentration at the defect becomes very high, and the propagation and, growth of the defects is very rapid, whereby the strength inherently possessed by the crystal is severely damaged.

A mesophase pitch derived precursor fiber can be converted to carbon fibber a dense structure by carbonization and graphitization at 1300° C. or higher. Such a dense fiber structure has a high tensile strength and high tensile modulus, but conversely, has a very low resistance to defects. A certain kind of disturbance as described in the present invention may be considered to resemble a micropore, which is not large enough to decrease the strength.

The fiber structure presented in the present invention has a dense when observed from as the whole fibers, but exist micropores substantially free from crystalline disturbance on the fiber surface layer portion, i.e., defects under specific conditions are imparted to the fiber surface, contrary to conventional methods, to thus form a novel fiber structure not found in the prior art.

It may be considered that such a certain kind of disturbance (micropore) has the effect of relaxing the concentration of the stress on potentially occurring macrodefects, to thereby effect an improvement of the tensile strength, and thus it may be considered that a fiber structure having an improved breaking toughness of the fiber itself is obtained.

EXAMPLES

The present invention will be described in detail with reference to Examples and Comparative examples. In the present invention, the various physical properties used for representing the characteristics of the pitch based carbon fibers and the starting material pitches were defined as follows.

(1) Fiber diameter, tensile strength and tensile modulus

The fiber diameter, tensile strength and tensile modulus were measured according to the methods shown in JIS-R-7601 (1986).

(2) Viscosity and softening point

The viscosity was determine by an equation of Hagen-Poiseuille based on data collected through a flow tester. The softening point was defined as a tempearature at which the visosity is 20,000 poise.

(3) Mesophase content

In this specification, "Mesophase" stands an optical anisotropic portion which can be detected by observation with a polarization microscope on a polished surface of solidified pitch embedded in resin. The mesophase content is defined as a ratio of the detected mesophase area relative to the total observed area.

(4) Toluene insoluble and quinoline insolubles

The toluene insoluble and quinoline insoluble contents were measured according to the methods shown in JIS-K-2425 (1978).

(5) Density

The density was measured at 23° C., and was determined by the Sink Float method with the fiber of about 1 mm length by using 31 kinds of aqueous zinc chloride solutions with densities of from 1.50 to 1.80 g/cm$^3$, in grades of 0.01, and 41 kinds of bromoformethanol solutions controlled from 1.80 to 2.20 g/cm$^3$, and in grades of 0.01.

Example 1

A coal tar pitch with a softening point of 80° C., as the starting material, from which quinoline insolubles were removed, was subjected to a reaction with tetrahydroquinolive as the hydrogenation solvent at 440° C. for 20 minutes under a pressure of 120 kgf/cm$^2$, and the solvent and the low boiling distillates were removed under a reduced pressure at 270° C. to obtain a hydrogenated pitch. This pitch was then subjected to a heat treatment under normal pressure at 480° C., and low boiling fractions were removed to obtain a mesophase pitch. The mesophase pitch had a softening point of 304° C., a content of toluene insoluble of 85% by weight and of quinoline insoluble of 14% by weight and a mesophase content of 95%.

According to method known in the prior art, by using a spinning machine having a nozzle pack with a capillary diameter of 0.14 mm and a nozzle hole number of 3000, pitch fibers with a fiber diameter of 13 μm were obtained from the mesophase pitch, the spinning viscosity of the pitch was 800 poise.

The pitch fibers were heated from 200° C. to 300° C. at a temperature elevation speed of 0.5° C./min. in air, and maintained at 300° C. for one hour to effect the infusibilization treatment and obtain infusibilized fibers. The infusibilized fibers were heated from 300° C. to 500° C. at 5° C./min. in a nitrogen gas, and maintained at 500° C. for 30 minutes to obtain low temperature carbonized fibers. Next, the low temperature carbonized fibers were treated in a furnace in a gas mixture atmosphere of 50% by volume of carbon dioxide gas and 50% by volume of nitrogen gas, at 800° C. for 17 minutes, to obtain precursor fibers. Then, the precursor fibers were heated to 875° C. at a temperature elevation speed of 20° C./min. and maintained at 875° C. for 15 minutes, to obtain pre-carbonized fibers.

The pre-carbonized fibers had a fiber diameter of 11.5 μm, a density of 1.73 g/cm$^3$, a BET specific surface area determined by nitrogen adsorption at −196° C. of 2.91 m$^2$/g, a pore volume determined by carbon dioxide adsorption at 25° C. of 0.065 ml/g, a pore distribution peak radius determined by the nitrogen adsorption method of 1.1 nm, and a pore volume of 0.003 ml/g. The nitrogen adsorption and carbon dioxide adsorption were measured by using about 3 g of a sample with Bellsoap 36 produced by Nippon Bell Kabushiki Kaisha. The nitrogen adsorption isothermal curve was measured for about 25 points between 30 torr to 760 torr, and the carbon dioxide adsorption for about 30 points from 30 torr to 760 torr, the adsorption equilibrium time was about 2 to 3 hours per one point.

Next, the precursor fibers were heated to 2300° C. at a temperature elevation speed of 40° C./min. to 2300° C., and maintained at 2300° C. for 15 minutes to obtain graphitized fibers. The oxidation weight reduction rate of the graphitized fibers obtained in air at 650° C. was 0.021 min$^{-1}$, the BET specific area determined by the krypton adsorption method at −196° C. was 0,262 m$^2$/g, and the pore volume determined by the carbon dioxide adsorption method at 25° C. was smaller than 0.0001 ml/g. The krypton adsorption measurement and the carbon dioxide adsorption method were carried out in the same manner as described above. The measurement of the oxidation weight reduction rate was made by using a Mettler TG-50 produced by Mettler. About 10 mg of the sample was charged into a cylindrical vessel made of alumina and having a diameter of 5 mm and a height of 4 mm and the measurement was conducted under the conditions an air flow rate of 30 Nml/min. The interlayer spacing $d_{002}$, of this graphitized fiber was 0.3420 nm and the crystallite size, Lc was 17.5 nm. the fiber diameter was 9.8 μm, the tensile strength was 390 kgf/mm$^2$, the tensile modulus was 68 tf/mm$^2$ and the density was 2.14 g/cm$^3$.

Comparative Example 1

The infusibilized fibers used in Example 1 were heated from 300° C. to 875° C. at 20° C./min. in a nitrogen gas atmosphere, and maintained at 875° C. for 15 minutes to obtain pre-carbonized fibers. The pre-carbonized fibers had a fiber diameter of 11.5 μm, a density of 1.73 g/cm$^3$, a BET specific surface area determined by nitrogen adsorption of 0.91 m$^2$/g, a pore volume determined by carbon dioxide of 0.064 ml/g, a pore distribution peak diameter of 1.5 nm, and a pore volume of 0.001 ml/g determined by the nitrogen adsorption method.

Next, the pre-carbonized fibers were heated to 2300° C. at a temperature elevation speed of 40° C./min. in an argon atmosphere and maintained at 2300° C. for 15 minutes to obtain graphitized fibers. The graphitized fibers obtained had an oxidation weight reduction rate of 0.011 min$^{-1}$ in air at 650° C., a BET specific surface area determined by the krypton adsorption method of 0.232 m$^2$/g, a pore volume determined by the carbon dioxide adsorption method smaller than 0.0001 ml/g. The interlayer spacing, $d_{002}$ of this graphitized fiber was 0.3421 nm and the crystallite size, Lc was 17.9 nm, the fiber diameter was 9.8 μm, the tensile strength was 255 kgf/mm$^2$, the tensile modulus was 66 tf/mm$^2$, and the density was 2.14 g/cm$^3$.

Comparative Example 2

The infusibilized fibers used in Example 1 ware heated from 300° C. to 500° C. at 5° C./min. in a nitrogen gas atmosphere and maintained at 500° C. for 30 minutes to obtain low temperature carbonized fibers. Next, the low temperature carbonized fibers were treated in a furnace in a gas mixture atmosphere of 50% by volume of carbon dioxide gas and 50% by volume of nitrogen gas at 850° C. for 30 minutes, to obtain precursor fibers. The precursor fibers were heated from 300° C. to 875° C. at 20° C./min., and maintained at 875° C. for 15 minutes to obtain pre-carbonized fibers. The pre-carbonized fibers had a fiber diameter of 11.3 μm, a density of 1.73 g/cm$^3$, a BET specific surface area of 1.25 m$^2$/g, a pore volume determined by carbon dioxide adsorption of 0.110 ml/g, a pore distribution peak radius determined by the nitrogen adsorption method of 1.6 nm, and a pore volume of 0.004 ml/g.

Next, the pre-carbonized fibers were heated to 2300° C., at a temperature elevation speed of 40° C./min. in an argon gas atmosphere and maintained at 2300° C. for 15 minutes to obtain graphitized fibers. The graphitized fibers obtained had an oxidation weight reduction rate in air at 650° C. of 0.070 min$^{-1}$, a BET specific surface area determined by the krypton adsorption method of 2.35 m$^2$/g, and a pore volume determined by the carbon dioxide adsorption method smaller than 0.0017 ml/g. The interlayer spacing, $d_{002}$ of this graphitized fiber was 0.3425 nm and the crystallite size, Lc was 17.1 nm, the fiber diameter was 9.8 μm, the tensile strength was 220 kgf/mm$^2$, the tensile modulus was 63 tf/mm$^2$, and the density was 2.14 g/cm$^3$.

Example 2

The decomposed residual oil (decant oil) obtained from the fluidized catalytic cracking device (FCC device) for petroleum heavy distillates was distilled to get an oil at a boiling point range of from 360° C. to 520° C., and using the oil as the starting material, a pyrolytic polymerization was carried out under a pressure of 0.5 kg/cm$^2$ and a temperature of 450° C. for 45 minutes while blowing nitrogen gas. Thereafter, the low boiling fractions were removed under a reduced pressure of 10 mmHg and a temperature of 460° C. for 20 minutes, to obtain a mesophase pitch.

The mesophase pitch had a softening point of 320° C., a toluene insulubles content of 82% by weight, a quinoline insoluble content of 35% by weight, and a mesophase content of 100%. According to the method known in the prior art, by using pitch, in a spinning machine having a nozzle pack with a capillary diameter of 0.14 mm and a nozzle hole number of 200, mesophase pitch fibers with a fiber diameter of 13 μm were obtained from this mesophase pitch, the spinning viscosity was 800 poise.

The pitch fibers were heated from 150 ° C. to 300° C. at a temperature elevation speed of 1° C./min. in air to obtain infusibilized fibers. The temperature of the infusibilized fibers was elevated in a nitrogen gas atmosphere from 200° C. to 500° C. at 5° C./min., and maintained at 500° C. for 30 minutes to obtain low temperature carbonized fibers. Next, the low temperature carbonized fibers were treated in a furnace in a gas mixture atmosphere of 25% by volume of carbon dioxide gas and 75% by volume of nitrogen gas, at 780° C. for 20 minutes, to obtain precursor fibers.

Then, the precursor fibers were heated to 875° C. at a temperature elevation speed of 20° C./min. in nitrogen atmosphere, and maintained at 875° C. for 15 minutes to obtain pre-carbonized fibers. The pre-carbonized fibers had a fiber diameter of 11.3 μm, a density of 1.70 g/cm$^3$, a BET specific surface area of 3.75 m$^2$/g, a pore volume determined by carbon dioxide adsorption of 0.093 ml/g, a pore distribution peak radius determined by the nitrogen adsorption method of 1.1 nm, and a pore volume of 0.004 ml/g.

Next, the pre-carbonized fibers were heated to 2300° C. at a temperature elevation speed of 40° C./min in an argon gas atmosphere, and maintained at 2300° C. for 15 minutes to obtain graphitized fibers. The graphitized fibers obtained had an oxidation weight reduction rate in air at 650° C. of 0.033 min$^{-1}$, a BET specific surface area determined by the krypton adsorption method of 0.286 m$^2$/g, and a pore volume determined by the carbon dioxide adsorption method smaller than 0.0001 ml/g. The interlayer spacing, $d_{002}$, of this graphitized fiber was 0.3415 nm and the crystallite size, Lc was 16.8 nm, the fiber diameter was 9.7 μm, the tensile strength was 375 kgs/mm$^2$, the tensile modulus was 58 tf/mm$^2$, and the density was 2.12 g/cm$^3$.

Comparative Example 3

The infusibilized fibers used in Example 2 were heated from 300° C. to 875° C. at a temperature elevation speed of 20° C./min. in a nitrogen gas atmosphere, and maintained at 875° C. for 15 minutes to obtain pre-carbonized fibers. The precarbonized fibers had a fiber diameter of 11.3 μm, a density of 1.73 g/cm$^3$, a BET specific surface area determined by nitrogen adsorption of 0.98 m$^2$/g, a pore volume determined by carbon dioxide adsorption of 0.084 ml/g, a pore distribution peak radius determined by the nitrogen adsorption method of 1.6 nm, and a pore volume of 0.001 ml/g.

Next, the pre-carbonized fibers were heated to 2300° C., at a temperature elevation speed of 40° C./min in an argon gas atmosphere, and maintained at 2300° C. for 15 minutes to obtain graphitized fibers. The graphitized fibers obtained had an oxidation weight reduction rate in air at 650° C. of 0.011 min$^{-1}$, a BET specific surface area determined by the krypton adsorption method of 0.260 m$^2$/g, and a pore volume determined by the carbon dioxide adsorption method smaller than 0.0001 ml/g. The interlayer spacing, $d_{002}$, of this graphitized fiber was 0.3413 nm and the crystallite Lc of 17.0 nm, and when the tensile strength and tensile modulus were measured, the fiber diameter was 9.8 μm, the tensile strength was 265 kgf/mm$^2$, the tensile modulus was 57 tf/mm$^2$, and the density was 2.12 g/cm$^3$.

Example 3

The pitch fibers used in Example 1 were heated from 150° C. to 300° C. at a temperature elevation speed of 1° C./min. in an oxidative gas having 5% by volume of nitrogen dioxide in air, and maintained at 300° C. for 30 minutes to obtain infusibilized fibers. The infusibilized fibers were heated from 300° C. to 380° C. at a temperature elevation speed of 5° C./min. in a nitrogen gas atmosphere to obtain precursor fibers.

Then, the precursor fibers were heated to 900° C. at a temperature elevation speed of 20° C./min. and maintained at 900° C. for 15 minutes to obtain pre-carbonized fibers. The pre-carbonized fibers had a fiber diameter of 10.9 μm, a density of 1.70 g/cm$^3$, a BET specific surface area of 9.56 m$^2$/g, a pore volume determined by carbon dioxide adsorption of 0.0564 ml/g, a pore distribution peak radius determined by the nitrogen adsorption method of 1.1 nm, and a pore volume of 0.005 ml/g.

Next, the pre-carbonized fibers were heated to 2300° C. at a temperature elevation speed of 40° C./min in an argon gas atmosphere, and maintained at 2300° C. for 15 minutes to obtain graphitized fibers. The graphitized fibers obtained had an oxidation weight reduction rate in air at 650° C. of 0.035 min$^{-1}$, a BET specific surface area determined by the krypton adsorption method of 0.275 m$^2$/g, and a pore volume determined by the carbon dioxide adsorption method smaller than 0.0001 ml/g. The graphite crystal parameters were a $d_{002}$ of 0.3417 nm and an Lc of 17.8 nm, and the fiber diameter was 9.5 μm, the tensile strength was 360 kgf/mm$^2$, the tensile modulus was 67 tf/mm$^2$, and the density was 2.14 g/cm$^3$.

Table 1 shows the properties of the pre-carbonized fibers, and Table 2 shows the properties of the graphitized fibers graphitized at 2300° C.

TABLE 1

| | Properties of Pre-Carbonized Fibers | | | | | | |
|---|---|---|---|---|---|---|---|
| | | | BET specific surface area | | Carbon dioxide | Dollimore-Heal method | |
| | Fiber diameter μm | Density g/cm$^3$ | Scope of claim m$^2$/g | Measured value m$^2$/g | adsorption pore volume ml/g | Total pore volume ml/g | Pore peak radius nm |
| Example 1 | 11.5 | 1.73 | 1.12–10.06 | 2.91 | 0.065 | 0.003 | 1.1 |
| Example 2 | 11.3 | 1.70 | 1.16–10.42 | 3.75 | 0.093 | 0.004 | 1.1 |
| Example 3 | 10.9 | 1.70 | 1.18–10.79 | 9.56 | 0.056 | 0.005 | 1.1 |
| Comparative Example 1 | 11.5 | 1.73 | 1.12–10.06 | 0.91 | 0.064 | 0.001 | 1.5 |
| Comparative Example 2 | 11.3 | 1.73 | 1.14–10.06 | 12.5 | 0.110 | 0.004 | 1.6 |
| Comparative Example 3 | 11.3 | 1.71 | 1.15–10.36 | 0.98 | 0.084 | 0.001 | 1.6 |

TABLE 2

Properties of 2300° C. Graphitized Fibers

| | Fiber diameter μm | Density g/cm³ | Oxidation weight reduction rate: Scope of claim 1/min | Oxidation weight reduction rate: Measured value 1/min | BET specific surface area: Scope of claim m²/g | BET specific surface area: Measured value m²/g | Carbon dioxide adsorption pore volume ml/g | Strength physical properties: Tensile strength kgf/mm² | Strength physical properties: Tensile modulus tf/mm² | Crystal parameters: $d_{002}$ nm | Crystal parameters: Lc nm |
|---|---|---|---|---|---|---|---|---|---|---|---|
| Example 1 | 9.8 | 2.14 | 0.015–0.061 | 0.021 | 0.191–0.596 | 0.262 | <0.0001 | 390 | 68 | 0.3420 | 17.5 |
| Example 2 | 9.7 | 2.12 | 0.015–0.062 | 0.033 | 0.195–0.608 | 0.286 | <0.0001 | 375 | 58 | 0.3415 | 16.8 |
| Example 3 | 9.5 | 2.14 | 0.016–0.063 | 0.030 | 0.197–0.615 | 0.275 | <0.0001 | 360 | 68 | 0.3417 | 17.8 |
| Comparative Example 1 | 9.8 | 2.14 | 0.015–0.061 | 0.011 | 0.191–0.596 | 0.232 | <0.0001 | 255 | 66 | 0.3421 | 17.9 |
| Comparative Example 2 | 9.8 | 2.14 | 0.015–0.061 | 0.070 | 0.191–0.596 | 2.35 | 0.0017 | 220 | 63 | 0.3425 | 17.1 |
| Comparative Example 3 | 9.8 | 2.12 | 0.015–0.061 | 0.011 | 0.193–0.602 | 0.260 | <0.0001 | 265 | 57 | 0.3413 | 17.0 |

As described above, the carbon fibers of the present invention and precursors thereof have the specific feature of their structure controlled of the surface characteristics there of, The carbon fibers having a novel structure of the present invention have an improved resistance to surface defects. More specifically, by improving the destruction resistance thereof, high performance carbon fibers having an improved tensile strength are provided.

Also, the carbon fibers having the novel structure according to the method of the present invention suffer little lowering of the strength due to surface defects formed after the preparation of the carbon fibers, and thus have a specific feature in that high performance fibers can be easily obtained.

We claim:

1. A graphitized fiber heat-treated at a temperature higher than 2300° C. in an inert atmosphere, having:

(i) an oxidation weight reduction rate A in dry air at 650° C. in the range defined by equation (1);

(ii) a BET specific surface area S determined by nitrogen or krypton adsorpt ion technique at −196° C. in the range defined by equation (2);

(iii) a pore volume determined by carbon dioxide adsorption technique at 25° C. of 0.001 ml/g or less, wherein:

$$\frac{0.15}{D} \leqq A \leqq \frac{0.6}{D} \quad (1)$$

$$\frac{1}{0.25D\rho} \leqq S \leqq \frac{1}{0.08D\rho} \quad (2)$$

where, A is the oxidation weight reduction rate in dry air at 650° C. in $min^{-1}$, S is the specific surface area determined by nitrogen or krypton adsorption technique at −196° C. in $m^2g^{-1}$, D is the mean monofilament diameter of the graphitized fiber in μm and ρ is the density of the graphitized fiber in $gcm^{-3}$;

(iv) a tensile modulus of 40 tf/mm² or higher;

(v) a tensile strength of 300 kgf/mm² or higher;

(vi) an interlayer spacing $d_{002}$ of 0.3435 nm or less: and (vii) a crystallite size Lc of 16.8 nm or more.

2. A pre-carbonized fiber obtained by a heat treatment at a temperature from 800° C. to 900° C. of a mesophase pitch derived pitch precursor fiber, having;

(i) a BET specific surface area S determined by nitrogen adsorption technique at −196° C in the range defined by equation (3);

(ii) a pore volume determined by carbon dioxide adsorption technique at 25° C. of 0.1 ml/g or less, wherein:

$$\frac{1}{0.045D\rho} \leqq S \leqq \frac{1}{0.005D\rho} \quad (3)$$

where, S is the specific surface area determined by the nitrogen adsorption technique at −196° C. in $m^2g^{-1}$, D is the mean monofilament diameter of the precarbonized fiber in μm and ρ is the density of the precarbonized fiber in $gcm^{-3}$;

(iii) a pore radius at the peak position of the pore distribution determined by the method of Dollimore-Heal from nitrogen adsorption isothermal curves measured by the constant pressure volume method at a temperature of −196° C. of 1.3 nm or less; and (iv) a total pore volume of 0.002 ml/gr or more.

* * * * *